United States Patent [19]

Wyka

[11] Patent Number: 4,738,169

[45] Date of Patent: Apr. 19, 1988

[54] WRENCH

[75] Inventor: Richard M. Wyka, Lucas, Ohio

[73] Assignee: Artesian Industries, Mansfield, Ohio

[21] Appl. No.: 21,525

[22] Filed: Feb. 25, 1987

Related U.S. Application Data

[63] Continuation of Ser. No. 810,587, Dec. 19, 1985, abandoned.

[51] Int. Cl.[4] ..... B25G 1/10; B25G 1/00

[52] U.S. Cl. ..... 81/492; 81/125.1; 81/900

[58] Field of Search ..... 81/125.1, 119, 121.1, 81/124.3, 124.7, 176.1, 900, 492; 76/114, DIG. 7; D8/17, 19, 21, 27, 28

[56] References Cited

U.S. PATENT DOCUMENTS

| | | | |
|---|---|---|---|
| D. 105,337 | 7/1937 | McNaught | D8/17 |
| 1,529,075 | 3/1925 | McIntyre | D8/17 |
| 2,391,394 | 12/1945 | Cogbill | 81/124.3 |
| 3,029,673 | 4/1962 | Godsey | D8/28 |
| 4,517,862 | 5/1985 | Garcia | 81/119 |
| 4,562,758 | 1/1986 | Stirling | 81/124.7 |

*Primary Examiner*—Frederick R. Schmidt
*Assistant Examiner*—Bradley I. Vaught
*Attorney, Agent, or Firm*—D. Peter Hochberg; Mark M. Kusner; Walter C. Danison, Jr.

[57] ABSTRACT

A wrench construction wherein the wrench can be formed from an injection molded plastic material, and includes a handle and respective first and second head members extending from the ends of the handle. One of the head members is larger than the other, and each head member defines at least a part of a regular polygon adapted to be drivingly engageable and disengageable with a fastener element, such as a nut or bolt. Each of the head members and the handle is of generally U-shaped cross-section and includes a plurality of transverse stiffner members that extend from the base of the U and across the legs thereof to provide desired strength and rigidity of the structure at light weight.

9 Claims, 2 Drawing Sheets

FIG. 1
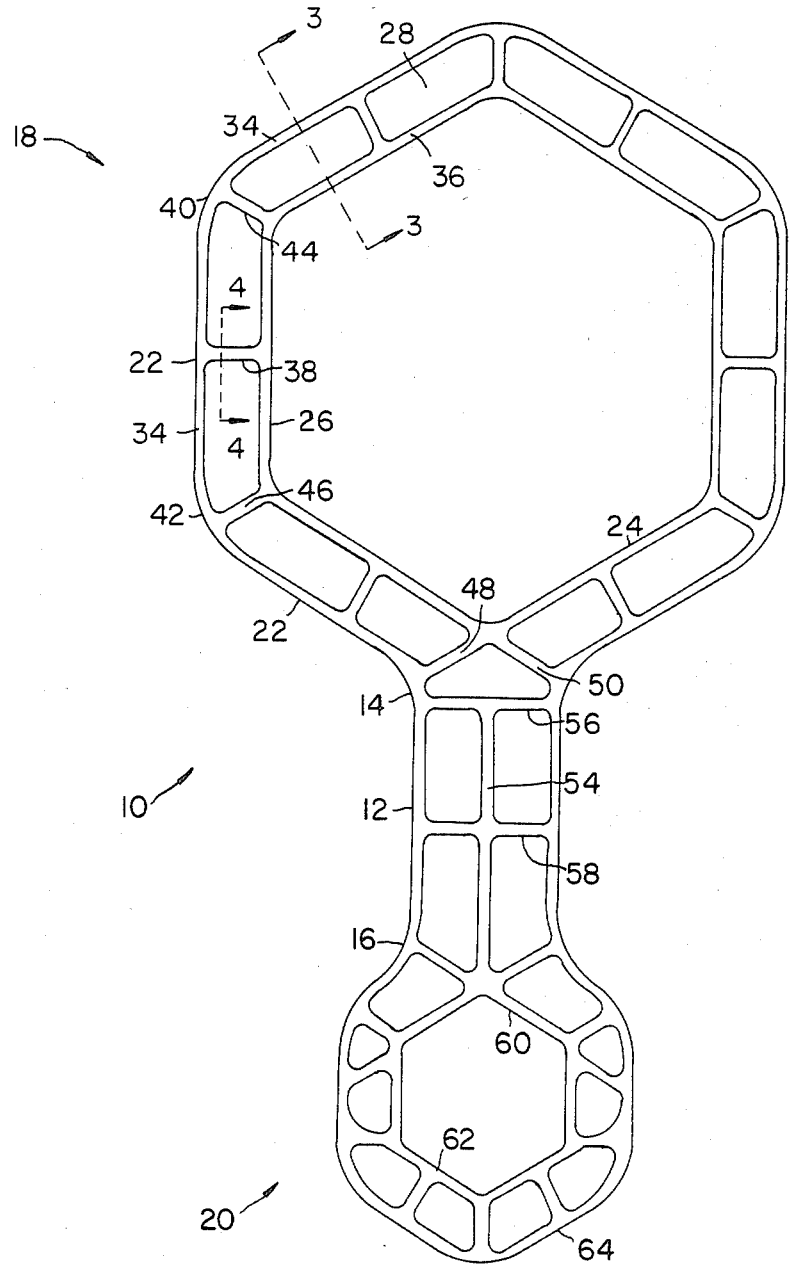
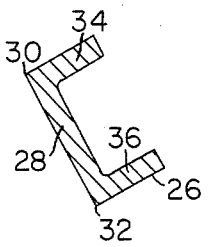
FIG. 3
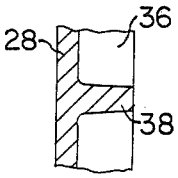
FIG. 4
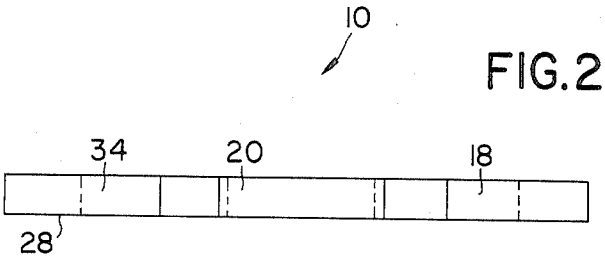
FIG. 2

WRENCH

This is a continuation of application Ser. No. 810,587, filed Dec. 19, 1985 and now abandoned.

BACKGROUND OF THE INVENTION

1. Field of the Invention

The present invention is directed to a wrench structure, and more particularly to an inexpensive and light weight, yet strong, wrench that can suitably be made by injection molding or rigid plastics.

2. Description of the Prior Art

Various manufacturers supply their goods in knocked down form or in the form of several parts intended to be assembled by the end user. The elimination of a final assembly step reduces the cost of the goods, and often the assembly is a simple operation that can be readily performed by the purchaser of the product.

For example, in the plumbing products field, china water tanks that are used in combination with a bowl to make up a complete toilet assembly have traditionally been packed by the manufacturer with the flush valve and water inlet regulator installed inside the tank. The valve and regulators are fastened to the tank bottom using a threaded nut by an assembler using a powered not runner. The assembly operation has been performed by the manufacturer principally because the large 1⅛" and 3" lock nuts frequently used on the components to be assembled are such a size that the average consumer, such as a homeowner, would not have readily available a wrench of the proper size to perform the assembly operation. Additionally, should adjustments become necessary to reduce or eliminate water leaks after installation of the toilet assembly, the absence of the proper tools would render such adjustments impossible, thereby requiring that the consumer seek the services of a plumber for those operations. However, if a suitably size wrench were to be provided with the tank, the assembly and adjustment operations could be performed by the consumer. However, the provision with such a tank of metal or similar wrenches of the proper size could involve excessive expense. It is therefore desirable to provide a suitable wrench that is both functional, and also low in cost.

SUMMARY OF THE INVENTION

Briefly stated, in accordance with one aspect of the present invention, a wrench is provided for turning threaded fastener elements having a plurality of flat external sides disposed about the axis of the fastener element and lying in respective planes parallel to the fastener element axis. The wrench includes a handle adapted to be manually gripped by the user for turning the fastener element. The handle includes at least one end having an opening defining at least a part of a regular polygon and formed from a plurality of connected legs. The opening has a size and shape to conform with the size and shape of the fastener to be turned, and adapted to be readily drivingly engageable and disengageable therewith. The handle and the head member each have a generally U-shaped cross-section defined by a base member and a pair of substantially parallel arms that extend outwardly from longitudinal edges of the base member, and include a plurality of transverse stiffener elements extending outwardly from the base in the direction of the arms and interconnecting the arms to provide desired strength and rigidity of the structure at a light weight.

BRIEF DESCRIPTION OF THE DRAWINGS

FIG. 1 is a plan view of a wrench in accordance with the present invention.

FIG. 2 is a side elevational view of the wrench illustrated in FIG. 1.

FIG. 3 is a cross-sectional view of the wrench taken along the line 3—3 of FIG. 1.

FIG. 4 is a fragmentary cross-sectional view of the wrench taken along the line 4—4 of FIG. 1.

DESCRIPTION OF THE PREFERRED EMBODIMENTS

Figure 5:
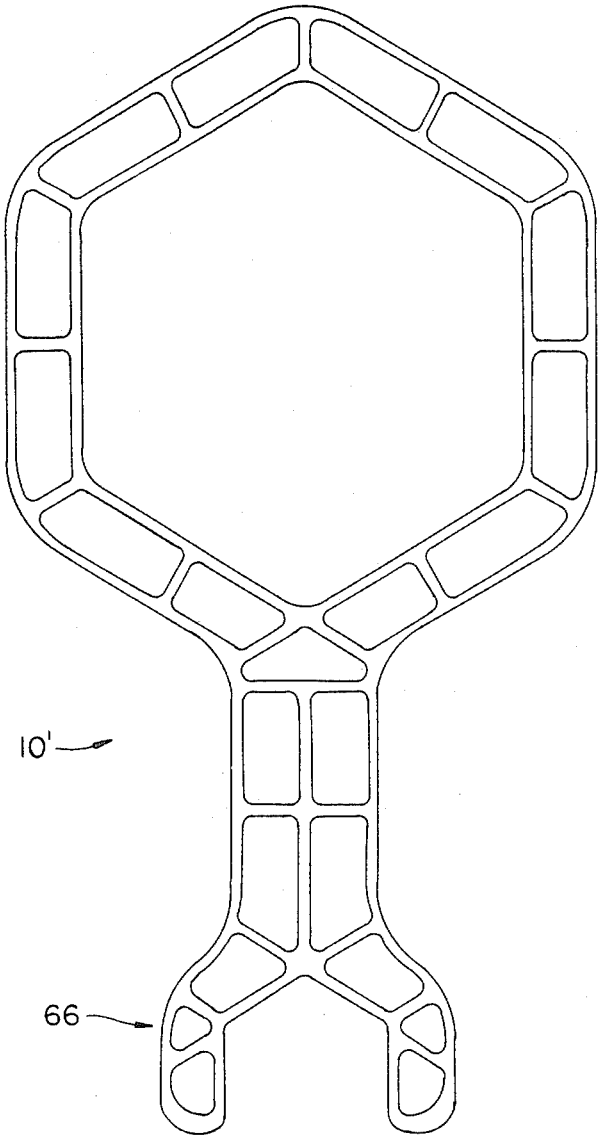
FIG. 5 is a plan view of an alternative embodiment of a wrench in accordance with the present invention.

Referring now to the drawings, and particularly to FIGS. 1 and 2, there is shown a wrench 10 in accordance with the present invention. The wrench connected to second end 16. The handle and first and second head members lie in a single plane as best seen in FIG. 2.

First head member 18 includes a plurality of interconnected legs 22 that are of generally linear form and when joined together define a regular polygon. In the embodiment illustrated in FIG. 1, the first head member is in the form of a hexagon, and includes a first opening 24 defined by the innermost surfaces 26 of the respective legs 22. The diagonal spacing between opposed innermost surfaces 26 is selected to fit over and engage a nut, such as, for example, a 3" nut (not shown).

The legs are each formed from a generally planar base member 28 having a predetermined width, the widthwise dimension terminating in a pair of longitudinal edges 30, 32. A pair of outwardly extending arms 34, 36 extend from longitudinal edges 30, 32, respectively in the same direction from base member 28, as most clearly seen in FIG. 3. The resulting generally U-shaped cross-section provides stiffness and rigidity to the first head member.

In addition to the generally U-shaped cross-section, each of legs 22 also includes a plurality of transverse stiffener members that extend outwardly from base member 28 in the same direction as arms 34, 36. One such stiffener member is illustrated in cross-section in FIG. 4, which shows stiffener member 38 that extends between arms 34 and 36 of leg 22, and that lies approximately at the midpoint between the respective ends 40 and 42 of leg 22. In that connection, it should be noted that the present description is of one such leg 22, and it should be understood that the remaining legs, although not specifically described, are of a similar construction, as clearly illustrated in FIG. 1.

In addition to transverse stiffener member 38, leg 22 also includes transverse end stiffener members 44 and 46 positioned at leg ends 40 and 42, respectively. the transverse end stiffener members extend obliquely to the longitudinal axis of leg 22. Moreover, as shown in FIG. 1, each of legs 22 shares a transverse end stiffener member with the adjacent leg 22. At the junction of handle 12 and first head member 18, a pair of obliquely positioned stiffener members are positioned, and each of oblique stiffener members 48 and 50 is a projected extension of inner arms 36 of the two legs that join with handle 12.

Handle 12 includes a central longitudinal axis that extends from the first head member 18 to second head member 20, and a transverse axis, and as seen in FIG. 1, handle 12 also includes at least one central longitudinal stiffener member 54, and a pair of spaced transverse stiffener members 56 and 58, each of which extends completely across the width of handle 12 and intersects and connects with central longitudinal stiffener 54.

The second head member 20 includes a second opening 60 that is defined by the respective innermost surfaces 62 of legs 64 that define the second head member 20. As with the first opening 24, second opening 60 is also of hexagonal shape, but is of a substantially smaller size, for example 1⅛". Second head member 20 is formed similar to first head member 18, and includes a plurality of stiffener members formed as integral parts of respective legs 64.

It can be seen that the numerous stiffener members provided between the arms of the various sections of the wrench as shown in FIG. 1 provide substantial strength to the structure. Accordingly, wrench 10 can be formed of a number of different materials, including structural plastics, such as PVC, ABS, Celcon, AST and Minlon for example, which can be injection molded to provide the illustrated structure. Such injection molded plastics provide a wrench structure that is suitable for the purpose of assembling various elements, such as the flush valve and water inlet regulator valve installed inside a china water tank forming part of a toilet assembly.

Although FIG. 1 shows a wrench structure having first and second openings that are completely closed to define a complete regular polygon, such as a hexagon, a wrench in accordance with the present invention can also be provided in a form wherein at least one of the head members does not define a closed regular polygon, but only a portion thereof. Such a structure is illustrated in FIG. 5, wherein a wrench 10' is provided with a modified second head member 66 that is open at the outermost end to define an open end wrench for use in situations where that structure is preferred over a closed end wrench.

Although various embodiments of the present invention have been illustrated and described, it will be apparent to those skilled in the art that various changes and modifications can be made without departing from the spirit of the present invention, and it is intended to encompass in the appended claims all such changes and modifications that fall within the scope of the present invention.

What is claimed is:

1. A molded, toilet tank assembly wrench for turning threaded fastener elements which attach a toilet flush valve and water regulator to a toilet water tank, said fastener elements having a plurality of flat external sides disposed about the axis of the fastener element and lying in respective planes parallel to the fastener element axis, said wrench comprising:

a. a handle adapted to be manually gripped by the user for turning the fastener element;

b. one end of said handle having a head member including an opening defining a part of a regular hexagon and formed from a plurality of legs, and the other end of said handle having a head member including an opening defining a closed regular hexagon and formed from six legs;

c. said handle and each of said head members having a generally U-shaped cross-section defined by a flat base member and a pair of parallel arms extending outwardly perpendicularly from longitudinal edges of the base member, and including a plurality of transverse stiffener member extending outwardly from the base member in the direction of said arms and interconnecting said arms, said legs forming said opening including at least one transverse internal stiffener member extending substantially perpendicularly to the arms of the U-shaped cross-section, and at least one transverse end stiffener member at an end of each of the legs, at least one of said transverse end stiffener members extending obliquely to the legs of the U-shaped cross-section, said wrench being molded and integrally formed of plastic material to provide desired strength and rigidity at light weight, the diagonal spacing between opposed legs being approximately 3 inches for one of said head members and approximately 1⅛ inches for the other head member.

2. A wrench in accordance with claim 1 wherein said transverse internal stiffener members are substantially midway between the ends of the respective legs.

3. A wrench in accordance with claim 1 wherein the adjacent legs have common transverse end stiffener members.

4. A wrench in accordance with claim 3 wherein the common transverse end stiffener members lie on a line that bisects the angles defined by adjacent intersecting legs.

5. A wrench in accordance with claim 1 wherein the handle includes a longitudinal axis and a transverse axis, and at least two transverse stiffener members and at least one central longitudinal stiffener member, said longitudinal stiffener member intersecting and interconnecting said at least two transverse stiffener members.

6. A wrench in accordance with claim 5 wherein each end of said handle includes a pair of oblique transverse stiffener members.

7. A wrench in accordance with claim 6 wherein said oblique transverse stiffener members intersect on the longitudinal axis of the handle.

8. A wrench in accordance with claim 1 wherein each of the head members includes an opening that defines a closed regular hexagon.

9. A wrench in accordance with claim 1 wherein the wrench is made from a plastic selected from the group consisting of PVC, ABS, Celcon, AST and Minlon.

* * * * *